United States Patent [19]

Meurer et al.

[11] Patent Number: 4,530,225

[45] Date of Patent: Jul. 23, 1985

[54] BENDING SKELP OR STRIP INTO SPLIT TUBES OR PIPES

[75] Inventors: Hans Meurer, Monchen-Gladbach; Josef Jordans, Korschenbroich, both of Fed. Rep. of Germany

[73] Assignee: Mannesmann AG, Duesseldorf, Fed. Rep. of Germany

[21] Appl. No.: 122,697

[22] Filed: Feb. 19, 1980

[30] Foreign Application Priority Data

Feb. 19, 1979 [DE] Fed. Rep. of Germany ..... 2906692

[51] Int. Cl.[3] ..... B21D 39/02

[52] U.S. Cl. ..... 72/52; 72/181; 228/17.5

[58] Field of Search ..... 72/52, 51, 178, 181, 72/182; 228/17.5, 147, 151

[56] References Cited

U.S. PATENT DOCUMENTS

| | | | |
|---|---|---|---|
| 854,136 | 5/1907 | Wiet | 72/52 |
| 2,736,284 | 2/1956 | Jacokes | 72/52 |
| 2,948,324 | 8/1960 | Penrose | 72/181 |
| 3,472,053 | 10/1969 | Chang | 72/178 |
| 3,903,723 | 9/1975 | Colbath | 72/181 |

*Primary Examiner*—Gene P. Crosby

*Attorney, Agent, or Firm*—Ralf H. Siegemund

[57] ABSTRACT

A strip-bending mill is assembled from a set of interchangeable stages, each stage imparting a particular curvature of the strip; a group of stages so assembled, stepwise bending a particularly wide strip or skelp into a tube. For bending a different width strip or skelp, a different group of stages is assembled, but usually including some of the previously used stages in different positions. None of the stages are adjustable. Particular simple construction features are able to be achieved.

11 Claims, 7 Drawing Figures

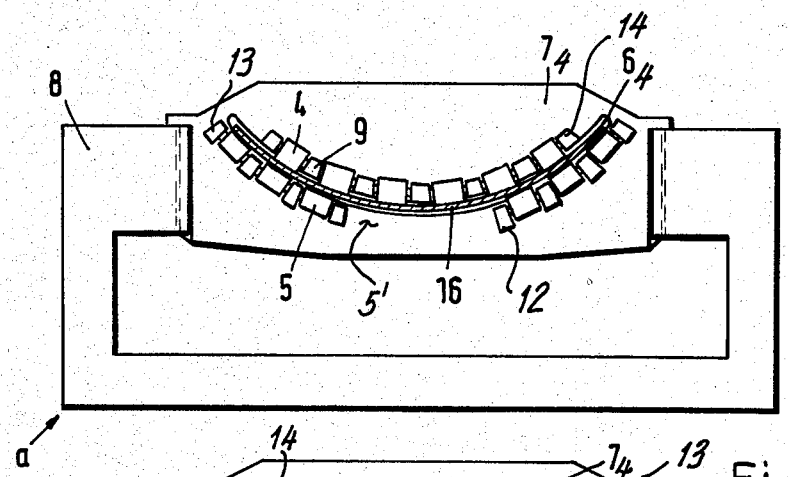
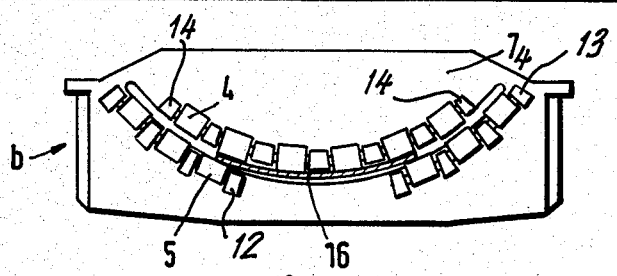
Fig.2
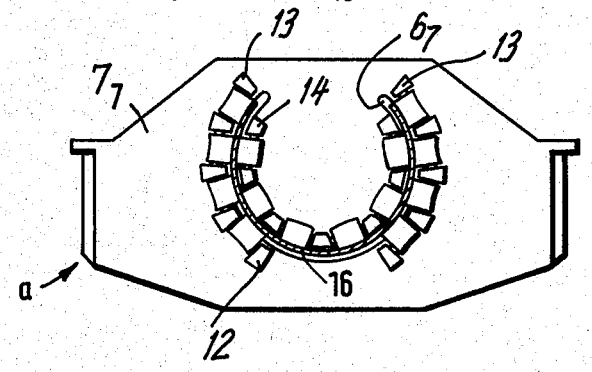
Fig.3
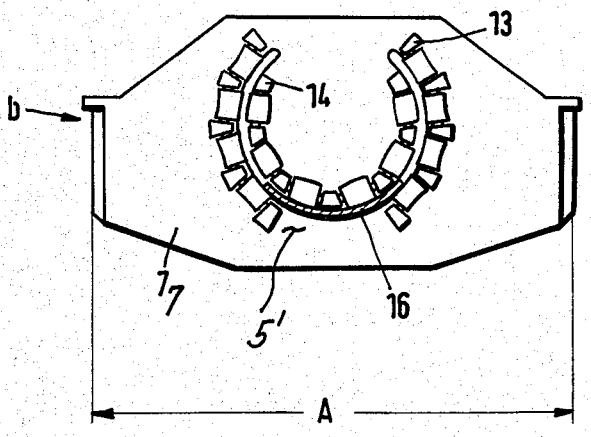

BENDING SKELP OR STRIP INTO SPLIT TUBES OR PIPES

BACKGROUND OF THE INVENTION

The present invention relates to the stepwise bending of metal strip or skelp into a split tube or pipe to be fed subsequently through a welding machine.

U.S. Pat. No. 3,472,053 discloses a tube mill, having a plurality of stands for bending strip stepwise into a split tube or pipe. Each stand receives a partially bend strip of trough-shaped contour and establishes a new, intermediate contour of particular arch length and increased curvature. Each stand is adjustable as to these working parameters so that the same mill can process differently wide strips in order to obtain tubes of different diameters. It is required to change and adjust each stand if differently wide skelp is to be processed, this being quite a cumbersome procedure. Moreover, these stands are rather heavy and large because they include more or less complicated adjusting mechanisms, and the bending rolls are variably mounted pursuant to their adjustment features.

DESCRIPTION OF THE INVENTION

It is an object of the present invention to provide a new and improved method and equipment for bending differently wide strips or skelps into tubes or pipes, the improvement being particularly related to facilitating equipment change when wider or narrower strips are to be formed into a tube.

In accordance with the preferred embodiment of the present invention, it is suggested to provide a plurality of bending stages constituting a set. Each stage provides for a particular degree of bending in the sense that a partially bent skelp is curled additionally by such a stage to a particular degree (curvature). The mill to be used for processing a strip or skelp of a particular width is assembled by selecting a group of stages from the plurality and placing them, e.g., into a frame. For processing a differently wide skelp or strip, a different group of stages is assembled, which may (and usually will) include some of the previously used stages, but in different positions. The plurality of stages available includes a little less than twice the number of stages per group. Moreover, the number of stages per group is always the same. The plurality of stages includes one for providing the smallest curvature and a last one for providing the largest curvature. These stages are never used together, but the first one serves as first stage in an assembly for bending the widest strip, and the last stage of the plurality, if used, is used as the last one in the mill for completing the smallest-diameter tube.

Each stage is comprised of a plate, all plates being similarly wide to fit into any of the positions of the frame. Each stage-plate has, for example, a slot, or the like, delineating the curvature to be imparted upon the strip or skelp by this particular stage; the curvature of these slots are all different, but many have the same arch length commensurate with the width of the strip or skelp to be bent into a split tube. Only those stages which may serve as output stages for smaller-diameter tubes have correspondingly smaller slots. Bending rolls are journalled adjacent to and along the slots, whereby no adjustment takes place when the stage is used for bending a differently wide strip; only its position changes in the frame. These rolls are preferably disposed on the side of the frame facing the strip; support rolls are preferably provided also along the slot, but or its other side, for supporting the skelp as it is fed to the next stage. The unused stages-plates are preferably disposed in a carriage which runs on rails along the frame.

DESCRIPTION OF THE DRAWINGS

While the specification concludes with claims, particularly pointing out and distinctly claiming the subject matter which is regarded as the invention, it is believed that the invention, the objects and features of the invention, and further objects, features, and advantages thereof will be better understood from the following description taken in connection with the accompanying drawings, in which:

FIG. 2 shows in the two portions (a) and (b) one and the same of the early, small-curvature stages for the tubeforming mill, for the shaping of two different width strips;

FIG. 3 shows analogously in two portions, a later, large curvature stage, for also shaping two different width strips;

Figure 1:
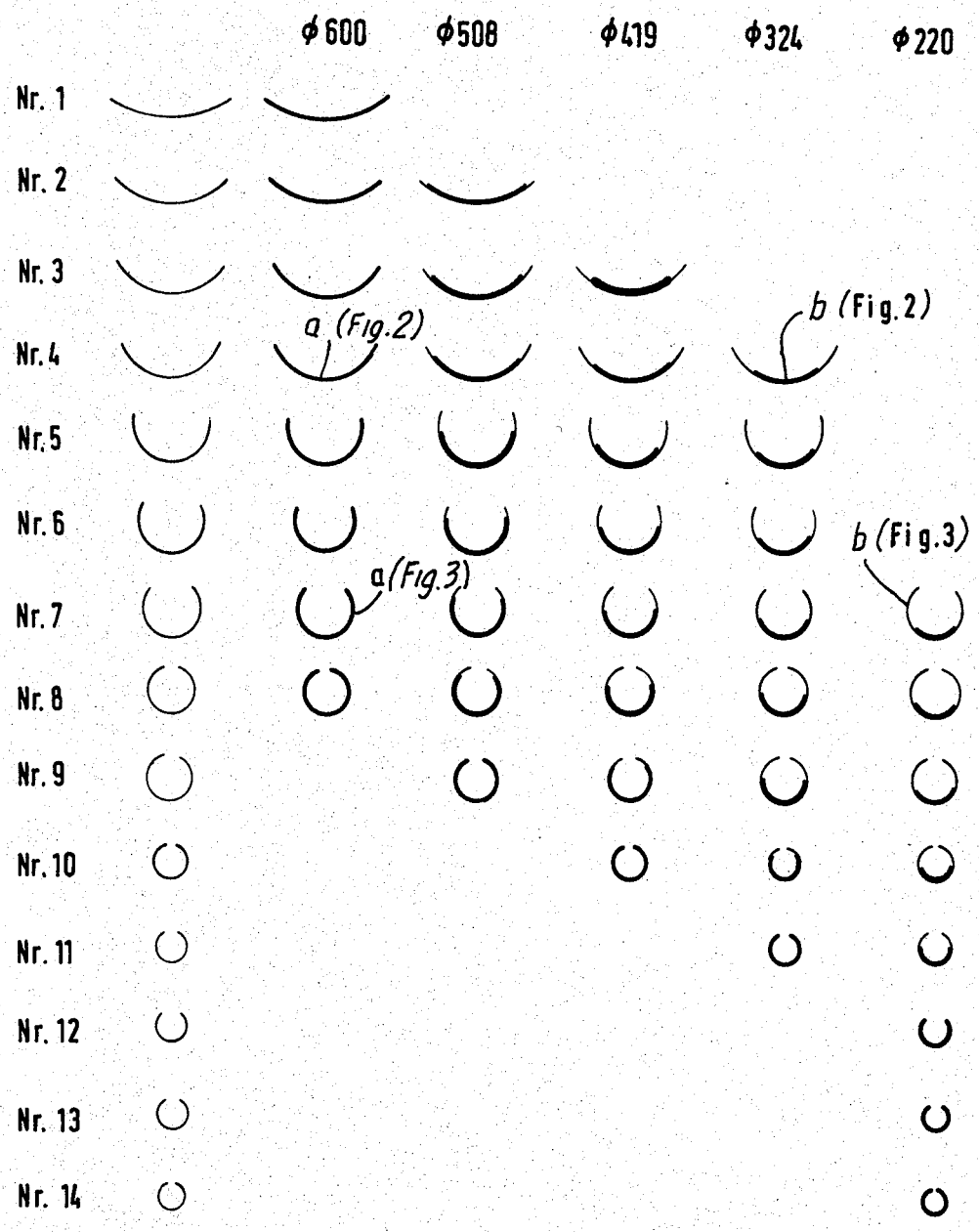
FIG. 1 is a table showing a schematic representation of the bending process of different width skelps or strips (horizontal), and in different groups of stages (vertical), identified by stage numbers.

Proceeding now to the detailed description of the drawings, the table of FIG. 1 illustrates the bending process as it applies to several, differently wide strips. In the figures plotted in the top row above, five of the seven columns denote the diameters (in millimeters) of the tubes made ultimately; and to be made by the equipment and mill described in greater detail below. This equipment includes a plurality of bending stages (for example, fourteen), and these stages are so identified along and in the left-hand column of the table.

The second column in the table of FIG. 1 identifies in respect to each stage, whose number appears to the left in each instance, the extent of skelp or strip curving as provided by such a stage. It is significant that the curvature imparted by any stage upon the (already curved) skelp or strip that it receives is the same, irrespective of the width of the strip or skelp being worked. Stage No. 1 is the one that provides the smallest curvature; stage No. 14 is the one that provides the largest curvature. All stages bend strip towards an axis.

The third column, under the identifying symbol $\theta$600, depicts schematically the bending of a rather wide piece of skelp or strip into a split tube (in eight stages), being the widest one to be processed. The top row position of the third column shows this skelp, but after having been prepared to assume a trough-shaped contour. As will be shown below, the skelp or strip arrives at the first stage, being stage No. 1 in this instance, and at a slightly, concavely curved contour, on account of the driving stage feeding the skelp into the mill. The split tube is completed upon leaving stage No. 8.

Generally speaking, the bending is carried out by a group of eight stages. The term "group" applies to the number of stages needed to complete a split tube. For this completion, one has to consider also the fact that the edges are extended by the process. This aspect is significant and instrumental because of the fact that the same number of stages can be used, but not the same stages for bending differently wide strips. Each group has, for example, eight stages; but eight different ones for tubes of different diameter dimensions.

All stages, including the intermediate stages, as assembled reduce the radius of curvature stepwise and in a uniform fashion from stage to stage. The term "uniform", as used here, is not to be meant in merely the geometric sense as to the change in the radius of curvature. Uniformity includes also a stepwise extending of the edges. Moreover, the skelp, as leaving any station or stage, does not necessarily follow precisely the contour of a circle. Thus, the radius of curvature may be of an average value, or the local radius of the skelp center. Ultimately, the split tube, produced in each instance, is very close to a circular contour.

A narrower skelp or strip, also pre-bent into a shallow trough, may be used to make a split tube having a diameter of 508 mm. For this (fourth column), stage No. 1 is removed, and the skelp is fed directly to stage No. 2 for further bending. On the other hand, stage No. 9 has been added because stage No. 8 does not close the narrower strip, as it did for completing the 600-mm pipe. Thus, the total number of stages used has remained the same, namely: eight. Furthermore, it can readily be seen that stages No. 2 through No. 8 are the same for the two cases. The skelp is bent in basically the same way within these stages, but the skelp is narrower so that a different output stage is needed. Stage No. 1 could still be used, but is superfluous. Processing of narrow strips is shown by indicating that the bending stages (thin lines) extend operatively beyond the edges of the narrower skelp (thicker line); but the curving, and in particular the resulting radius of curvature, is the same for each stage, regardless of the width of the skelp which it happens to process, and regardless of the relative position of such a stage in the assembled group.

The columns identifying the making of a 419-mm-diameter tube and a 324-mm-diameter tube show the removal of, respectively, stage No. 2 and stages No. 2 and No. 3, while, respectively stage No. 10 and stages No. 10 and No. 11 have been added to the mill. The relative narrow strip leading to a 220-mm-diameter tube (last column) requires the last eight stages, No. 7 through No. 14, only. It should be noted, by way of example, that the output stage for completing the bending of the widest strip into a split tube (600 mm diameter), namely stage No. 8, is only the second stage, right next to the input stage for bending the narrowest strip.

From a different point of view, each one of the stages No. 8 through No. 14 may serve as an output stage; and each of them is, therefore, constructed as a completing stage for a split tube of a particular diameter. As a consequence, the bending of the narrowest strip involves, in fact, all seven of such "completing stages," all but one being used here as an intermediate stage.

Broadly speaking, therefore, the mill includes a total of n (e.g., $n=14$) stages; and for each tube diameter and skelp width, one needs just m (e.g., $m=8$) stages. This means that the system can make $n-m+1$ (e.g., seven) tubes of different diameters. Changeover from one strip width to another one, therefore, does not involve changing any of the stages; but adding and subtracting specific stages at the feeding side and at the exit side. In other words, for each tube size to be made, one assembles a particular group of stages by using a particular subset of (in this example, altogether eight) stages, selected from a set having a total of fourteen stages. The selection will, in each instance, involve eight consecutive stages; though this may, in principle, not be necessary.

After having explained the principles involved, we now turn to the specific details. FIG. 2 shows, for example, stage No. 4, and FIG. 3 shows stage No. 7. Moreover, case "a" in FIG. 2 represents stage No. 4, when used for bending a wide strip leading to a 600-mm-diameter tube. Case "b" in FIG. 2 represents the same stage, but bending a narrower strip for a 324-mm-diameter tube. The decisive point is that the degree of bending, as provided, is the same in both instances so that these stages do not have to be adjusted or modified; only their relative position in the assembly of eight bending stages differs. Analogously, stage No. 7, as depicted in FIG. 2, is shown to bend the wide 600-mm-diameter tube strip (case "a"), while case "b" in FIG. 3 shows the use of stage No. 7 as the first or input stage for bending the smallest strip that can be processed. These several instances have also been identified in FIG. 1.

Figure 4:
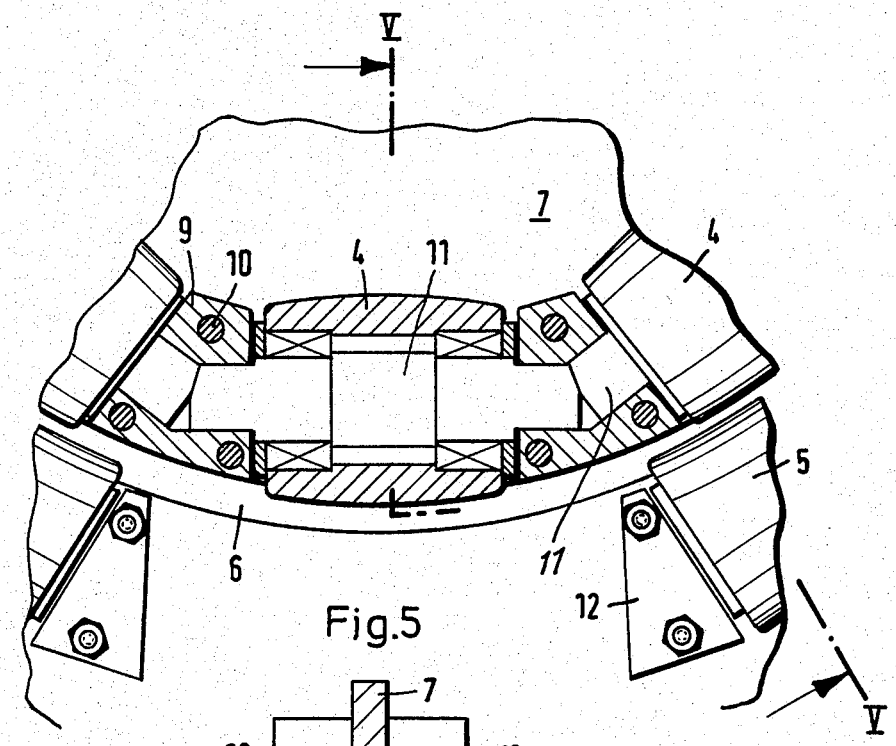
FIG. 4 is an enlarged view, particularly in sections, of a portion of any one bending stage.

The stage depicted in FIG. 2 (see also FIGS. 4 and 5 for further details) includes a plurality of bending rolls 4 with a bulging, i.e. convex, periphery and defining an upper set of bending rolls. A plurality of concavely contoured rolls 5 is disposed underneath. Thus, a blank 16 is sandwiched between upper rolls 4 and lower rolls 5, and is bent. The two sets of rolls can also be regarded as defining a bending plane; and they are disposed next to a curved working gap or slot 6 of a semicircular contour and have been worked (burned) into a plate 7 (denoted $7_4$ in FIG. 2, and $7_7$ in FIG. 3). This plate is held in a frame 8. Plate 7 may, for example, be slid into grooves in the frame, to be held more or less loosely therein. Thus, these plates 7 are more or less easily replaceable and repositionable in frame 8. As will be shown more fully below (and was alluded to above), for each bending task, a particular group of plates 7 is assembled in the frame, whereby some plates are the same but have different positions in the frame (see Frame 8 in FIG. 6).

Figure 5:
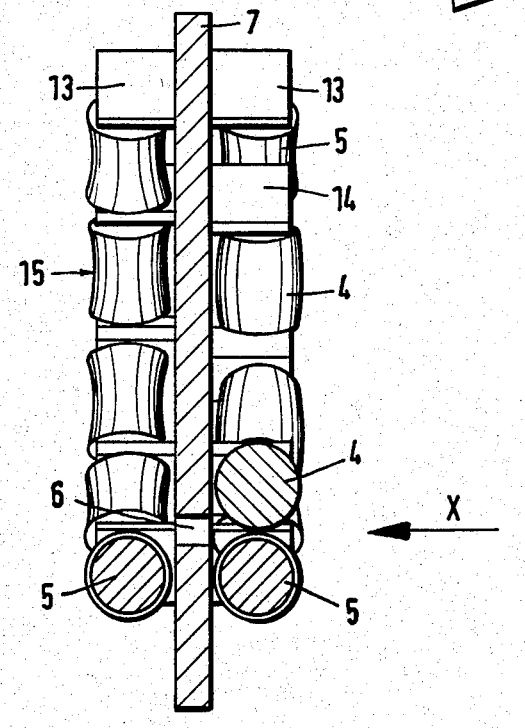
FIG. 5 is a section view identified by line V—V in FIG. 4, but on a reduced scale.

As shown more fully in FIG. 5, there are actually two sets of concave rolls 5, one set on each side of a plate 7. The arrow (X) denotes the direction of skelp movement. A downstream set 15 of concave rolls is basically provided to support the resilient edges of the skelp in between this stage and the next one. The arch length of this curved assembly 15 is the same as the length of the row of working rolls 5 on the other side of plate 7.

The upper rolls 4 extend in a continuous row over not quite the same length of slot 6. The row of lower rolls 5 extends to the ends of slot 6, but its middle portion is interrupted. Gap 5' in the row of rolls 5 has a length which is a bit shorter than the narrowest strip to be processed. The gap is, in each instance, actually defined by end bearings 12 for two of the rolls 5.

Bearing mounts 9 are interposed between adjacent rolls 4 and between adjacent rolls 5. The two outermost rolls 4 (on each side of a plate 7) are mounted in the bearings of mounts 14, and the outermost rolls 5 are analogously journalled in the bearings of mounts 13. The orientation of the two axes in any of the mounts 9 defines and delineates the respective curvature of the row of rolls, corresponding to the curvature of the respective adjacent slot 6. In reality, the rows of rolls establish a polygon which approximates the curvature of its respective slot 6. These mounts 9, 13, 14, etc., are fastened to plate 7 by means of bolts 10. The bearings are specifically provided to journal the respective shafts 11 of the rolls.

As stated, the specific mounting plate for stage No. 4 is identified in FIG. 2 by $7_4$, and its slot is specifically identified by $6_4$. The height of that plate and the curvature of slot $6_4$ is unique to this stage. Thus, stage No. 7 has a mounting plate $7_7$ of greater height and its slot $6_7$ has a larger curvature. On the other hand, the width A of the various plates is the same for all stages because they have to fit in various positions in the same frame 8.

Figure 6:
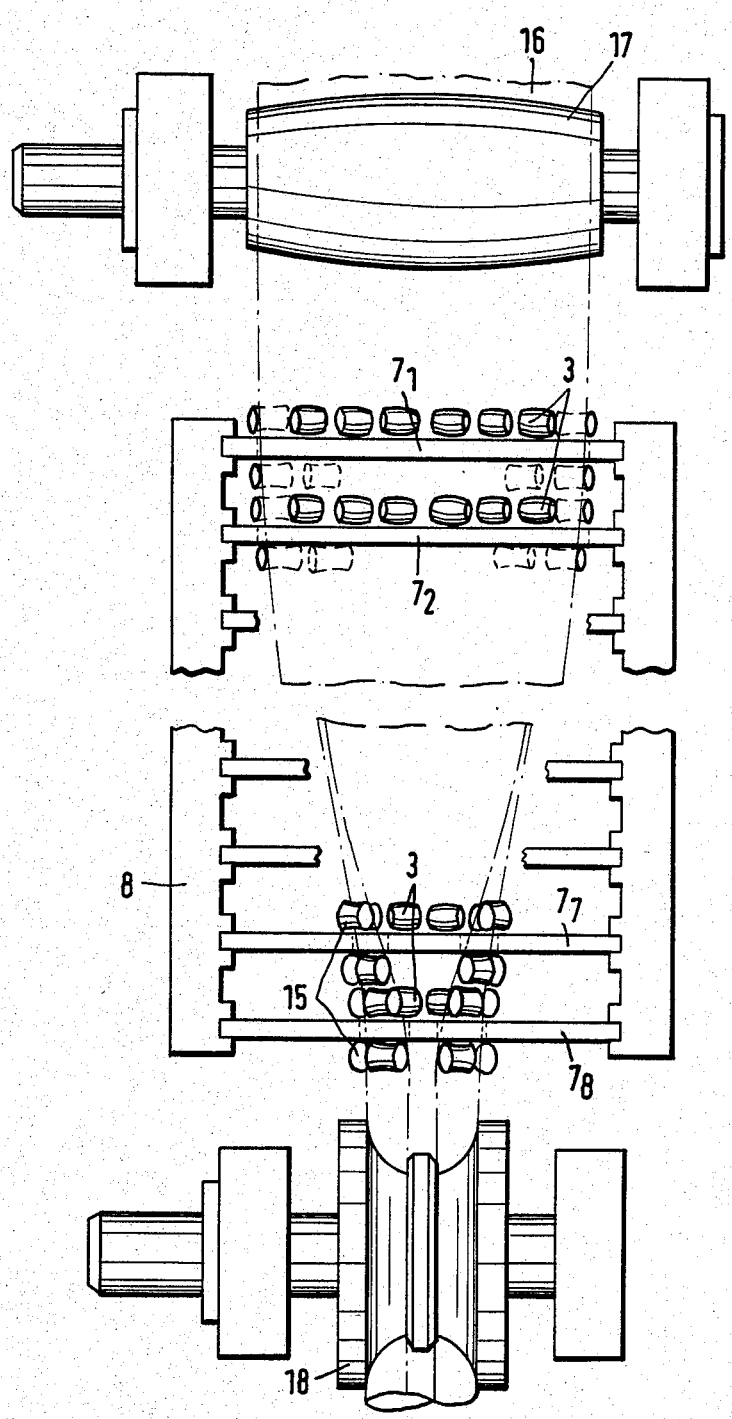
FIG. 6 is a top view of several stages, including the first and last stages of a strip-bending mill, as assembled, illustrating the preferred embodiment for practicing the best mode of the invention.

Proceeding now to the description of the overall system, FIG. 6 shows the relatively large frame 8 into which plates $7_1$ to $7_8$ are inserted. That is to say, the mill, as illustrated, is provided and adjusted to bend a relatively wide strip. "Adjustment" in this context means and relates to a particular assembly of a particular group of stages: plates 7. Since the plates are removably mounted in frame 8, a series or group of plates can be inserted at will. Thus, in order to work a narrower strip into a, say, 508-mm-diameter tube, plate 7 would be removed and plate $7_2$ would take its place. All other plates are analogously shifted down by one position, and plate $7_8$ would be placed into the slots now holding plate $7_7$, and another plate defining stage No. 9 would be inserted in the last pair of slots in frame 8, now holding plate $7_8$.

This frame with eight bending stages is interposed between a first stand 17, which concavely bends a strip or skelp, upon being unwound from the coiler. Actually, stage 17 is provided to draw a strip or skelp 16 from the coiler. The eight plates and stages 7 to $7_8$ form the strip stepwise into a split tube of 600-mm diameter, as shown also in the third column of the table in FIG. 1. The split tube, as made, is fed to a cutter 18. This cutter is one of three and is placed downstream from the mill and upstream from a welding station.

Figure 7:
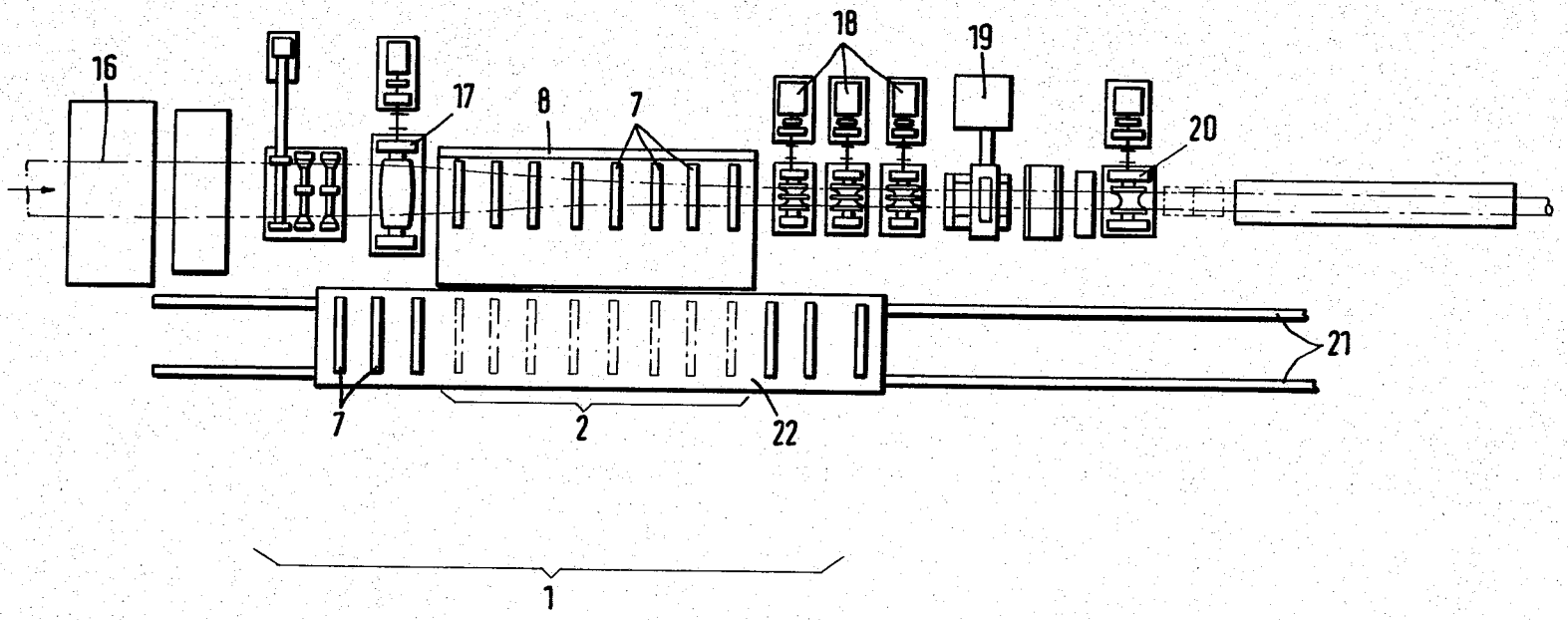
FIG. 7 is a schematic top elevation of the entire equipment, shown in parts in FIG. 6, but being drawn to a smaller scale.

As shown in FIG. 7, the split tube after passing through the three cutters 18 passes through a welder 19 and a sizing stage 20. Next to the mill, and particularly next to frame 8, one can see a rail track 21 for a carriage 22. This carriage resembles frame 8 in the sense that it has slots, receiving stage plates 7. In particular, this carriage 22 holds all those plates which are not being used and are not presently assembled in frame 8. Carriage 22 is constructed in such a way that it may hold all plates 7; for example, when this particular set of fourteen plates is not used at all.

The specific situation depicted in FIG. 7 has the machine or mill adjusted in order to produce a 324-mm-diameter tube (see FIG. 1). Store and carriage 22 holds the first three stages and the last three stages, while the plates 7 for stages No. 4 through No. 11 are inserted in frame 8. For convenience of handling, plates 7 are mounted in carriage 22 analogous to their being mounted and assembled in frame 8 whenever used. This plate storage may be analogous to the storage of tools in a tube-stretch-reducing mill, for particularly obtaining the ease of lateral displacement and mounting.

The invention is not limited to the embodiments described above; but all changes and modifications thereof, not constituting departures from the spirit and scope of the invention, are intended to be included.

We claim:

1. A method of making split tubes of different diame ters by stepwise bending different width metal strip o skelp towards and around a longitudinal axis, compris ing the steps of:

providing a placeable plurality n of bending stages each causing a particular reduction in radius o curvature of the strip or skelp, most of the stage provided for bending a relatively wide strip o skelp;

selecting from said plurality n a first group of r stages, without modifying the stages of the grou as so selected, for use of stepwise bending a firs strip or skelp of a particular weidth;

feeding the first strip or skelp through the first grou of stages to obtain a split tube;

selecting from said plurality a second group of als altogether m stages which includes some of the stages as selected for the first group, and withou modifying the stages to be used in common, for us of stepwise bending a second strip or skelp of another particular width;

feeding the second strip or skelp through the second group of stages to obtain a split tube;

whereby the first strip is bent first by a first stage o the first group which is different from a first stage of the second group that first bends the second strip; and whereby said plurality of bending stages include as many possible last stages for completing a split tubes as there are different diameters for tubes to be accommodated.

2. A method of making split tubes of different diameters by stepwise bending different width metal strips or skelps around a longitudinal axis, comprising the steps of:

providing a plurality of bending stages, each causing a particular reduction in radius of curvature of the strip or skelp and including a first stage for imparting upon such a strip or skelp a relatively small curvature, being the smallest, as provided by any of the stages, and further including a last stage for imparting upon a bent strip or skelp a relatively large curvature, being the largest, as provided by any of the stages;

selecting a first group of bending stages, including not more than one of the first and second stages;

passing a first strip or skelp through the first group to obtain a first split tube, whereby one of the stages of the first group as selected serves as a first bending stage for this particular selection;

selecting a second group of bending stages which includes some stages, but not all stages of the first group, and without changing said same stages, the second group including additional stages which had not been included in the first group; and passing a second strip having a width different from the first strip through the second group of stages to obtain a second split tube, whereby one of the stages of the second group as selected serves as a first bending stage for this particular selection and being positively a different one which served as a first bending stage in the selection of the first group.

3. A method as in claim 2, each of said groups having the same number of stages.

4. A method as in claim 1 or 2, said groups being about half the number of stages of the plurality.

5. A mill for stepwise bending strip or skelp into a split tube, the strip or skelp being taken up from a coiler, or the like, and fed from the mill to a welding station, the mill being provided for bending different width strip of skelp into tubes of correspondingly different diameters, the tubes of different diameters following a series, comprising:

a frame means defining a plurality m of positions;

a first plurality m of bending stages in the frame means receiving the strip or skelp as taken, and stepwise being it into a split tube, and being removably placed, respectively, into the plurality of positions of the frame means;

a second plurality n-m of bending stages provided for replacing individually at least one of the stages of the first plurality, as the remaining stages of the first plurality are rearranged in the frame means, without changing their respective bending function, resulting in a different assembly of stages in the frame means and being provided for bending a different width strip or skelp into a different diameter split tube, whereby for tubes of different diameters being next to each other in said series, only two stages from the second plurality are required for replacing two stages from the first plurality in order to change the mill from making tubes of one of said different diameters to making tubes of the other one of said different diameters.

6. A mill as in claim 5, each of said stages of the first and second plurality including a plate with a curved slot, convex rolls journalled above the slot, and concave rolls journalled below the slot.

7. A mill as in claim 6, the plates of several of said stages having a similar dimension in one direction, corresponding to a dimension in the frame means, in the said positions.

8. A mill for stepwise bending strip or skelp into a split tube, the strip or skelp being taken up from a coiler, or the like, and fed from the mill to a welding station, comprising:

frame means defining a plurality of positions;

a first plurality of bending stages in the frame means receiving the strip or skelp as taken, and stepwise bending it into a split tube, and being removably placed, respectively, into the plurality of positions of the frame means;

a second plurality of bending stages provided for replacing individually at least one of the stages of the first plurality, as the remaining stages of the first plurality are rearranged in the frame means, without changing their respective bending function, resulting in a different assembly of stages in the frame means and being provided for bending a different width strip or skelp into a different diameter split tube; and wherein each one of the stages includes a plate with a curved slot, a plurality of convex rolls journaled above the slot and a plurality of concave rolls journaled below the slot so that the strip or skelp is gripped by at least one convex roll on the inside of the tube to be made and by at least one concave roll from the outside of the tube to be made.

9. A mill as in claim 5, or 8 including a carriage means and rail means for the carriage means disposed alongside said frame means, said carriage means holding said second plurality of stages.

10. A mill as in claim 6 or 8, said rolls being arranged on one side of the plate, each stage further including a set of holding rolls along the slot on the other side of the plate.

11. A mill as in claim 6 or 8, the slots in several of said stages having different radii of curvature but similar arch lengths, corresponding to the widest strip or skelp, the remaining stages serving as output stages for bending narrow strips or skelps.

* * * * *